US007240588B1

(12) United States Patent
Rinner

(10) Patent No.: US 7,240,588 B1
(45) Date of Patent: Jul. 10, 2007

(54) METHOD OF MAKING A TOOL FOR EXTRACTING A BROKEN SCREW

(75) Inventor: James A. Rinner, Racine, WI (US)

(73) Assignee: Teleflex Medical Incorporated, Durham, NC (US)

( * ) Notice: Subject to any disclaimer, the term of this patent is extended or adjusted under 35 U.S.C. 154(b) by 641 days.

(21) Appl. No.: 10/171,899

(22) Filed: Jun. 17, 2002

(51) Int. Cl.
*B12K 5/00* (2006.01)

(52) U.S. Cl. ..... 76/119; 81/53.2; 606/104

(58) Field of Classification Search ..... 76/114, 76/108.1, 104.1, 101.1, 119; 606/104; 81/53.2, 81/120, 121.1, 124.6, 186; 29/426.4–426.5; 72/370.02–370.04, 298
See application file for complete search history.

(56) References Cited

U.S. PATENT DOCUMENTS

| | | | | |
|---|---|---|---|---|
| 906,040 | A | 12/1908 | Lucas | |
| 1,548,835 | A | 8/1925 | French | |
| 1,590,200 | A | 6/1926 | McGuckin | |
| 1,683,796 | A | 9/1928 | Pearce | |
| 1,709,998 | A * | 4/1929 | Mirfield | 72/342.1 |
| 2,684,526 | A | 7/1954 | Hoover | |
| 2,750,821 | A | 6/1956 | Hilsinger | |
| 2,752,671 | A | 7/1956 | Alyea | |
| 3,106,233 | A | 10/1963 | Wolny | |
| 3,161,090 | A | 12/1964 | McLellan | |
| 3,508,321 | A | 4/1970 | Wood | |
| 3,735,650 | A | 5/1973 | Weng | |
| 3,910,139 | A | 10/1975 | Blaskovic | |
| 3,996,819 | A | 12/1976 | King | |
| 4,204,308 | A | 5/1980 | Marling | |
| 4,389,913 | A | 6/1983 | Drouin | |
| 4,688,315 | A | 8/1987 | Jannke | |
| 5,201,104 | A | 4/1993 | Winkeljann | |
| 5,337,476 | A * | 8/1994 | Orsini, Jr. | 29/888.1 |
| 5,607,432 | A | 3/1997 | Fucci | |
| 5,649,931 | A | 7/1997 | Bryant | |
| 5,697,935 | A | 12/1997 | Moran | |
| 5,737,981 | A * | 4/1998 | Hildebrand | 81/53.2 |
| 5,951,554 | A | 9/1999 | Holmes | |
| 6,015,413 | A | 1/2000 | Faccioli | |
| 6,267,025 | B1 | 7/2001 | Sand | |

* cited by examiner

*Primary Examiner*—Kenneth E. Peterson
*Assistant Examiner*—Phong Nguyen
(74) *Attorney, Agent, or Firm*—Baker & Hostetler LLP

(57) ABSTRACT

The method of making a tool for removal of broken screws from a base material, including the material of the bone of a medical patient. One end of the tool has an open bore with interior, left-hand tapered screw threads formed thereon by compressing the tool to form the taper after the threads are formed and presented in a cylindrical shape. The other end of the tool is solid for accommodating a driving tool which rotates the tool in the removal of the broken screw.

6 Claims, 2 Drawing Sheets

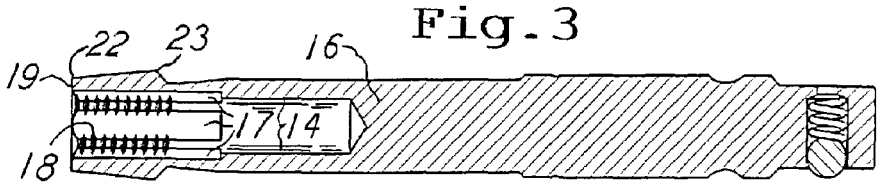
Fig. 3
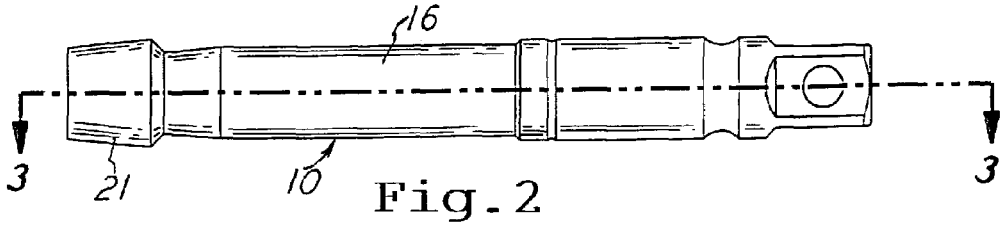
Fig. 2
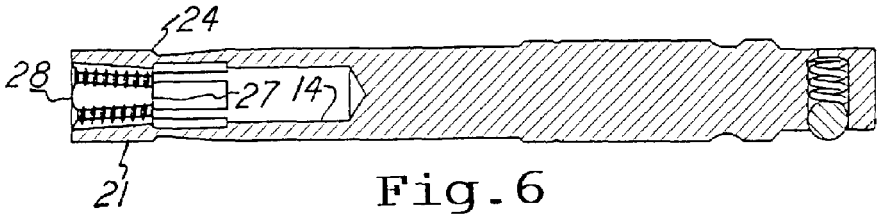
Fig. 6
Fig. 5
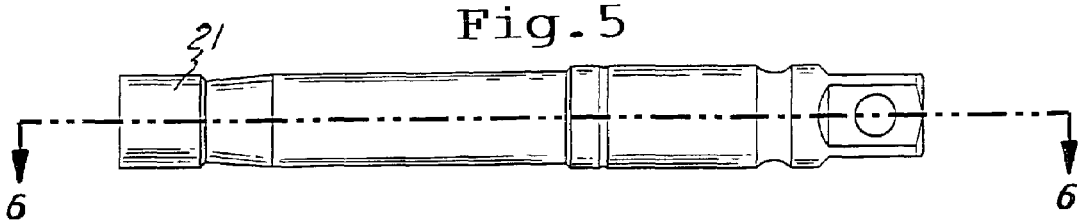
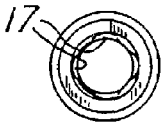
Fig. 4
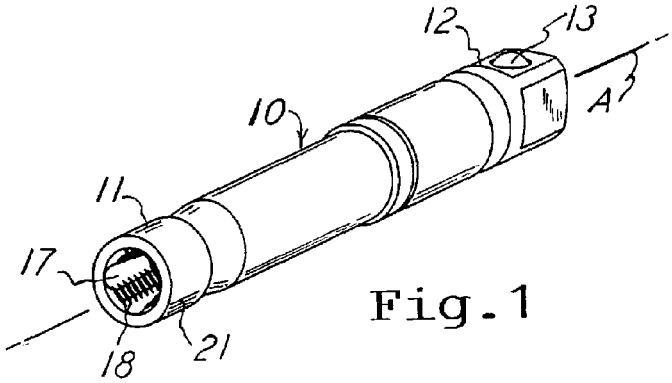
Fig. 1

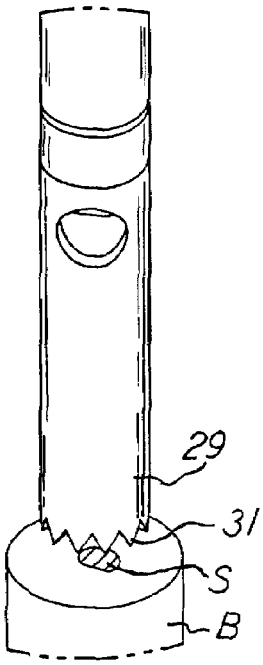
Fig.7
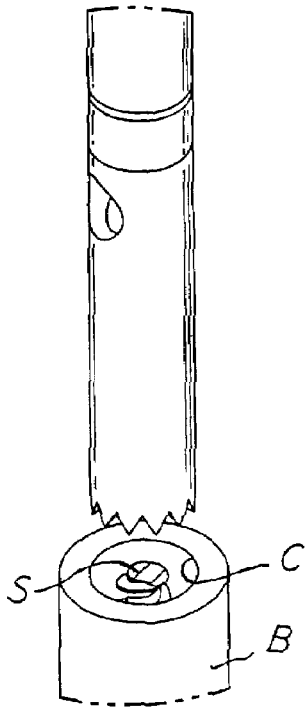
Fig.8
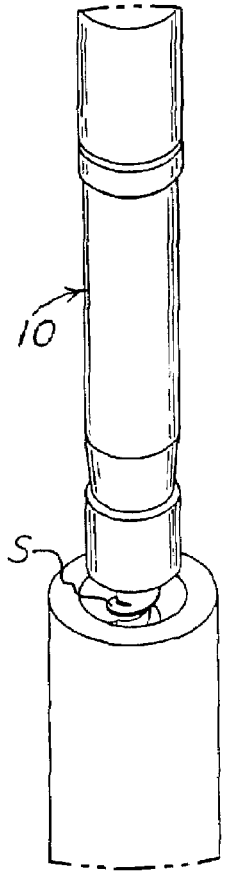
Fig.9
Fig.10
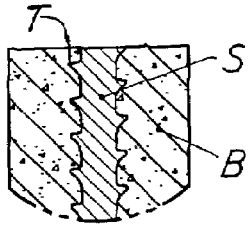
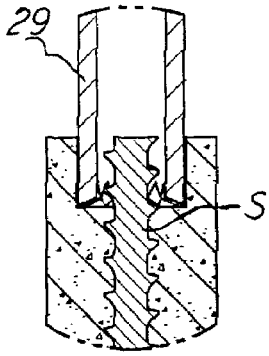
Fig.11
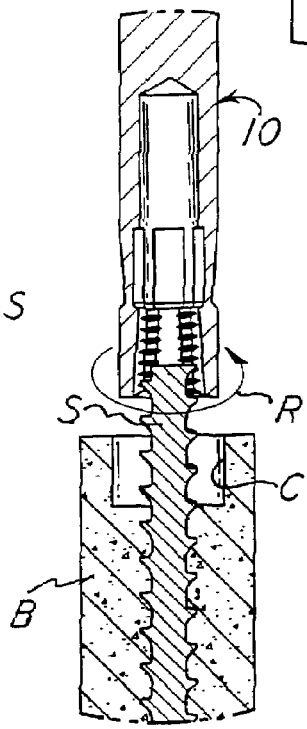
Fig.12

METHOD OF MAKING A TOOL FOR EXTRACTING A BROKEN SCREW

This invention relates to a method of making a tool for extracting a broken screw from a base, such as in the case of a broken fastening screw which has been embedded into bone to secure the bone together in a selected orientation in a person's skeleton. This tool is useful in removing the broken screw from bone, and it will be described in that context.

BACKGROUND OF THE INVENTION

In the customary condition where the orthopedic surgeon has threadedly embedded a screw into bone, those screws do break while in use in the bone. The breaks are such that the screw head is broken off, and revision removal of that broken screw then becomes a problem. Screw breakage can occur through the patient's movement of the skeleton at the location of the fastening screw which is otherwise holding the skeleton together.

The prior art is aware of instruments for removing broken screws from bone, and those instrument have their own screw threads which attach to the broken screw for reverse turning of the screw for its removal. Those instruments also have a tapered opening at their threads for telescoping with the broken screw to grip it in the removal process.

The present invention provides a method of making a broken screw remover instrument which is relatively easily manufactured to be precise in its construction for efficient removal of broken screws. In that surgical removal procedure, time and accuracy are vital, and the instrument of this invention permits quick and accurate removal.

BRIEF DESCRIPTION OF THE DRAWINGS

FIG. 1 is a perspective view of the instrument of this invention in its final form.

FIG. 2 is an enlarged top plan view of the instrument of FIG. 1 but at an earlier stage of making it.

FIG. 3 is a sectional view taken on along the plane designated by the line 3-3 of FIG. 2.

FIG. 4 is an end elevational view of FIG. 3.

FIG. 5 is a top plan view of the instrument and is similar to FIG. 2 but at a later stage of making the instrument.

FIG. 6 is a sectional view taken on the plane designated by the line 6-6 of FIG. 5.

FIG. 7 is a perspective view of bone with a broken screw seen therein and with a trephine for boring the bone.

FIG. 8 is a perspective view similar to FIG. 7 but showing more of the broken screw and showing the bore in the bone.

FIG. 9 is a perspective view similar to FIG. 8 but showing the instrument of this invention in position relative to the bone.

FIG. 10 is a sectional view of bone and a broken screw embedded therein.

FIG. 11 is a sectional view similar to FIG. 10 but showing a fragment of the trephine and the bore in the bone.

FIG. 12 is a sectional view similar to FIG. 11 but showing the instrument of this invention engaged with and in position ready to commence the removal of the broken screw from the bone.

DETAILED DESCRIPTION OF THE PREFERRED METHOD OF MAKING THE INSTRUMENT

The first sheet of drawings shows the method of making the instrument of this invention. FIG. 1 shows the instrument

10 in its completed form where it is seen that the instrument 10 is generally cylindrical and extends elongated along a longitudinal axis A. It is preferably made out of a metal material, such as stainless steel. FIG. 1 shows the instrument 10 has a screw-engaging end 11 and a driving end 12 for rotating the instrument 10 about it axis A by conventional drive means. The end 12 is shown to be a solid block of metal material to which a driver can fit over and be held thereto on the exterior thereof by the usual spring-loaded ball 13.

FIGS. 2 and 3 show the instrument 10 at a preliminary stage of manufacture, and the instrument has a drilled central bore 14 extending into the instrument elongated body 16 and part way along and co-axially with the axis A. As seen in FIGS. 3 and 4, four elongated grooves 17 are also formed in the body 16 at the bore 14 and they extend for a part of the total length of the bore 14. Screw threads 18 are also cut into the body 16 at the bore 14 and they extend concentric with the axis A throughout their length but for a short distance in the bore 14 and from the terminal edge 19 of the body 16. The threads 18 are preferably left-hand threads. The edge 19 presents a planar end surface therealong on the plane perpendicular to the axis A.

It will be seen and understood that the threads 18 are not continuously and endlessly circular in their position in the bore 14, instead they are circularly interrupted by the grooves 17. That renders the threads 18 more effective in biting into the broken screw, as hereinafter explained.

FIGS. 2 and 3 also show a frusto-conical end 21 of the body 16. That end 21 has one circumference at 22 and another and larger one at 23. However, at this stage of manufacturing, the bore 14 and the threads 18 are both cylindrical throughout their respective lengths, as seen in FIG. 3.

FIGS. 1, 5, and 6 all show that the end 21 is in a cylindrical shape on the exterior thereof. That is, the circumferential exterior of the end 21 is parallel with the axis A. That shows that the end 21 has been re-formed to acquire the shape shown in those three views, namely, the cylindrical shape extending throughout the axial length of the end 21. That transition arranges the threads 18 in a tapered pattern along the axis thereof, as desired for engagement of the broken screw.

To achieve the transition of shape from FIG. 2 to that of FIG. 5, the circular portion in the location of the circumference at 23 is compressed to then have a smaller circumference at 24. Thus, as seen in FIG. 6, the inner diameter of the bore 14 at the location 27 has been reduced while the inner diameter at the location 28 remains at its full and original size. That results in the threads 18 being tapered inwardly from the location 28 toward the location 27. That is the bore 14 extends to its diametrical reduction at 27.

In making the instrument 10, it is preferred that the original metal is substantially presented in a cylindrical shape, then the bore 14 and threads 18 and grooves 17 are formed therein, as seen in FIG. 3. Then the area at 23 is compressed, such as by swaging, to achieve the exterior cylindrical shape and the interior conical shape of the portion 21, both shapes being co-axial and as seen in FIGS. 5 and 6. Thereby, the left-hand and tapered threads are created. Finally, the instrument 10 can be heat treated.

The second sheet of drawings shows bone B, and FIGS. 7 and 8 show a bone cutter or trephine 29 with cutters 31 for boring into the bone B to form a counter-bore C therein. A broken screw S is shown embedded in the bone B, and only its threaded shank is shown affixed in the bone B. It is assumed that the screw head (unshown) has broken away from the shown shank, and that presents the problem of removal of the remaining broken screw. FIG. 10 shows the section view of the bone and the embedded screw S, with right-hand threads T, and FIG. 11 shows the trephine 29 forming the bore C into the bone B and concentric with the screw S.

FIG. 12 shows the lower fragment of the instrument 10 in gripping relationship with the screw S and having commenced extraction of the screw S from the bone B. That is achieved by applying the instrument 10 on the upper end of the screw and rotating the instrument 10 in the counter-clockwise direction, shown by the arrow R, and thereby have it bite into the screw with its threads 18 which cut into the shown right-hand threads on the screw S. Further rotation of the instrument 10 will fully extract the screw S from the bone B, as desired.

Of course, if the screw S is not fully contained by the bone B, contrary to that as shown, then there would be not need to cut the bone away from the broken screw by the use of the trephine 29 or any other cutter.

As mentioned at the outset herein, this tool 10 is useful in removing broken screws from any base material, so consider reference B to be that material, and not be limited to bone.

While a specific method of making the shown embodiment of the instrument 10 is disclosed herein, it should be apparent that equivalent changes could be made in the process. For instance, the reduction of the circumference at 23 could be by forcing on that circumference other than by conventional swaging. The point is that the threads 18 are reshaped to a tapered configuration.

What is claimed is:

1. A method of making a tool for the removal of broken screws from a base material, comprising the steps of:

providing a tool body body with a longitudinal axis and an external frusto-conical terminal end with the larger diameter of said end being at an axial location spaced axially inwardly along said body and with said body having an interior cylindrical wall concentric with said axis and extending for a length into said body and presenting a cylindrically shaped bore, forming screw threads on said wall and having said threads extend along said wall to the axial extent to said location, and after the threading step, compressing said body in the area of said location to change the shape of said wall, and thereby said threads, from said cylindrical shape to an inwardly tapered shape.

2. The method of making a tool for the removal of broken screws from a base material, as claimed in claim 1, further comprising:

said body is compressed by swaging said body in the area of said location to form said tapered shape.

3. A method of making an instrument for the removal of broken screws from bone, comprising the steps of:

providing an instrument body with a longitudinal axis and an external frusto-conical terminal end with the larger diameter of said end being at an axial location spaced axially inwardly along said body and with said body having an interior cylindrical wall concentric and said axis and extending for a length into said body and presenting a cylindrically shaped bore, forming screw threads on said wall and having said threads extend along said wall to the axial extent to said location, and after the threading step, compressing said body in the area of said location to change the shape of said wall, and thereby said threads, from said cylindrical shape to an inwardly tapered shape.

4. The method of making an instrument for the removal of broken screws from bone, as claimed in claim 3, wherein:

said body is compressed by swaging said body in the area of said location to form said tapered shape.

5. The method of making an instrument for the removal of broken screws from bone, as claimed in claim 4, wherein:

said screw threads are formed as left-hand threads, and heat treating said body.

6. The method of making an instrument for the removal of broken screws from bone, as claimed in claim 5, including:

forming grooves in said wall and extending axially on said body and through said screw threads to have said screw threads discontinuous in their circular extent.

* * * * *